United States Patent [19]

Svoboda

[11] 4,311,321

[45] Jan. 19, 1982

[54] SKI BINDING

[75] Inventor: Josef Svoboda, Schwechat, Austria

[73] Assignee: TMC Corporation, Baar, Switzerland

[21] Appl. No.: 56,201

[22] Filed: Jul. 10, 1979

[30] Foreign Application Priority Data

Jul. 11, 1978 [AT] Austria ..... 4987/78

[51] Int. Cl.[3] ..... A63C 9/00

[52] U.S. Cl. ..... 280/611; 116/DIG. 11

[58] Field of Search ..... 280/612, 611, 623, 624, 280/625, 626, 627, 628, 629, 630, 631, 632, 634; 116/DIG. 11, DIG. 1, 1

[56] References Cited

U.S. PATENT DOCUMENTS

| | | | |
|---|---|---|---|
| 3,367,672 | 2/1968 | Tonozzi et al. | 280/612 |
| 3,876,219 | 4/1975 | Smolka et al. | 280/628 |
| 3,892,980 | 7/1975 | Anderson | 280/612 |
| 3,902,730 | 9/1975 | Tschida et al. | 280/625 |
| 4,140,331 | 2/1979 | Salomon | 280/612 |

FOREIGN PATENT DOCUMENTS

| | | | |
|---|---|---|---|
| 2705174 | 8/1977 | Fed. Rep. of Germany | 280/612 |

*Primary Examiner*—Joseph F. Peters, Jr.
*Assistant Examiner*—Milton L. Smith
*Attorney, Agent, or Firm*—Blanchard, Flynn, Thiel, Boutell & Tanis

[57] ABSTRACT

A ski binding having both a toe jaw and a heel holder. An electrical circuit is incorporated in the toe jaw and heel holder and indicates whether the ski boot is correctly clamped therebetween. The electrical circuit includes switch contacts located at strategic points on the toe jaw and the heel holder to indicate when the sole of the ski boot is not properly oriented relative to the toe jaw and heel holder.

7 Claims, 22 Drawing Figures

(CONDITION 5)

(CONDITION 6)

(CONDITION 8)

(CONDITION 11)

(CONDITION 12)

(CONDITION 13)

SKI BINDING

FIELD OF THE INVENTION

The invention relates to a ski binding having a front jaw and a heel holder for receiving a ski boot, which in the downhill skiing position is urged against the front jaw by means of a thrust spring associated with the heel holder, and during an overload is released by the binding, which jaw and heel holder have electrical circuit structure thereon for indicating an improper ski boot engagement.

BACKGROUND OF THE INVENTION

Ski bindings of the above-mentioned type have been known for a long time in many various forms. Such ski bindings serve the safety of the skier by the ski boot being held between the front jaw and the heel holder up to a predetermined limit, and upon an exceeding of this limit, namely upon the occurrence of an overload, which would mean already a danger of injury to the foot of the skier, the ski boot is released by one of the two ski binding parts. The front jaw functions generally to facilitate a lateral release of the ski boot and the heel holder facilitates a release in the vertical direction. Also various ski bindings are known, in which to overcome so-called twisting falls, which are particularly dangerous to the foot of the skier, predetermined directions are additionally effective. Such a heel holder is described for example in Austrian Pat. No. 305,843 (corresponds to U.S. Pat. No. 3,876,219).

For the perfect functioning of all of these known so-called safety ski bindings, which are also called release ski bindings, the presence of a perfect ski boot (without wear) and the correct positioning of the ski boot in the ski binding are a prerequisite. Even if during the construction of ski bindings the weather conditions on the slopes are considered, it is necessary for the perfect functioning of each type of ski binding that the connection between the ski boot and the ski binding takes place satisfactorily. Only in this manner namely it will be possible for the ski binding to meet its safety function and also the task, to connect the skier to the ski and to take care of both a safe skiing and also, if necessary, a correct release.

However, the ski boot becomes dirty due to use in the snow, be it through intentional walking in the snow or due to a fall, due to contact with the snow or with the iced-up slope. Undesired accumulations of snow, ice or the like will take place on the sole, tip and/or heel of the ski boot, which a careless skier often does not remove sufficiently, so that such accumulations prevent the correct positioning of the ski boot in the ski binding. By inserting an unclean ski boot into the ski binding, the entire function of the ski binding is disturbed. Accumulations in the area of the ball of the foot or on the upper side of the tip of the boot increase the friction forces between the stepping plate (sliding plate) and the sole hold-down means; accumulations below the heel of the boot result in an incorrect closing of the binding and thus in a change in the release values of the release spring in the heel holder; accumulations at the tip of the boot or at the heel in longitudinal direction of the ski change the clamping force between the two ski binding parts. All these and similar sources of errors finally lead to an uncontrolled release, which can occur sooner or later than desired. A further disadvantage of these sources of error lies in the inability to be able to consider them in advance during construction of ski bindings. Such errors can also be created by an incorrect installation.

Here the invention begins and has the purpose of indicating these sources of error and to inform the skier in a noticeable manner of the incorrect insertion of the ski boot.

The set purpose is attained by the ski binding having associated therewith an electric circuit having a current source, for example a battery and at least one element for emitting a signal which can be noticed by human senses, for example a light emitting lamp a sound emitting alarm or the like, in which circuit are provided, in a logical series and/or parallel connection, closing and/or breaking contacts which, upon occurrence of nonpermissible forces between the ski boot and at least one ski binding part, react and effect an emitting of the signal.

In this manner any nonregular condition of the ski boot in relationship to the ski binding can be indicated, so that the installer and/or the skier is or are being warned and the necessary changes, corrections or the like can be performed. The inventive controlling mechanism also offers the possibility for repeating any number of checks. The signal is emitted until the regular condition between the ski boot and the concerned ski binding part is achieved.

A preferred embodiment of the invention consists of each contact reacting only when a ski boot is incorrectly inserted for the area which is controlled by the contact, wherein at least one of the contacts is constructed as a so-called main contact, without the operation of which the other contacts which are associated with it cannot be operated effectively.

Due to the fact that a contact is associated with those points of the individual ski binding parts which can come into contact with the ski boot and, for this reason, do not at all permit an incorrect insertion of the ski boot because of the occurrence of a noticeable signal due to an incorrectly inserted ski boot, the set purpose is attained satisfactorily. This signal can be designed by the man skilled in the art in a conventional manner so that it does not cause an annoyance to other skiers. In other words, the signal is emitted right away during an incorrect insertion of the ski boot into the ski binding and thus prior to the skier starting the actual skiing.

A particularly preferable embodiment of the invention consists of the element which generates the signal being associated with a conventional contact breaker. The use of a contact breaker, which is well known for example in the case of turn signal blinkers for cars of all kinds, also for nondrivers from the street traffic, increases the assurance that incorrect insertion of the ski boot will be recognized because such signals more strongly influence the senses of the human than continuously acting signals. It does not matter, as already stated, whether the signals are a light or sound signal. It remains within the scope of the invention, if simultaneously a light and a sound signal are generated and it also lies within the scope of the invention if one of these signals is interrupted and the other one is continuous.

BRIEF DESCRIPTION OF THE DRAWINGS

Further characteristics, advantages and details of the invention are described in more detail with reference to the drawings, which illustrate one exemplary embodiment.

In the drawings.

DETAILED DESCRIPTION

Figure 1:
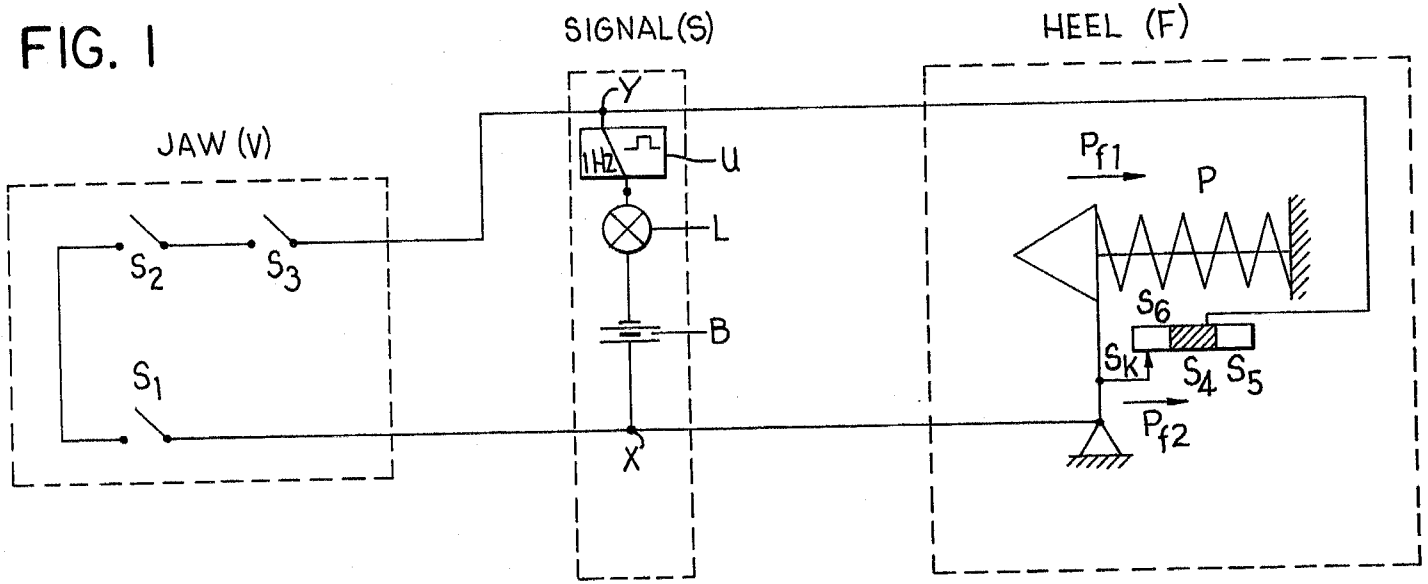
FIG. 1 illustrates a schematically illustrated ski binding with an inventive circuit arrangement for a front jaw and for a heel holder.

As one can see from FIG. 1, a battery B and a lamp L which is an element which gives off a signal, are switched at the points X and Y into a circuit which is not identified separately. This divides the circuit into two parts, wherein the one circuit part includes the front jaw V with contacts $S_1$, $S_2$, $S_3$ and the other circuit part includes the heel holder F with a sliding contact $S_k$ and the contact surfaces $S_4$, $S_5$, $S_6$. A power-producing spring P is provided in the heel holder F. As is known, the ski boot is held down in a direction toward the ski by the force of the spring P. The sliding contact $S_k$ is designed such that the lamp L becomes illuminated only when the heel holder F is moved into an incorrect closing position, and the sliding contact $S_k$ is moved in direction of the arrow $P_{f2}$ onto the effective contact surface $S_4$. If the heel holder F is closed with a ski boot located between the two ski binding parts, which position is indicated in FIG. 1, the sliding contact $S_k$ engages the dead contact surface $S_6$ and no signal is produced. If the heel holder is open (ready for stepping in), the sliding contact $S_k$ is moved in direction of the arrow $P_{f2}$ still further onto the dead contact surface $S_5$ and no signal is produced.

Figure 2:
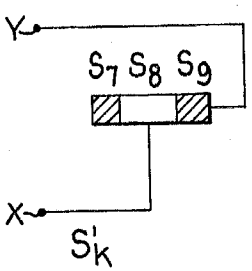
FIG. 2 illustrates a modification of the sliding contact in the heel holder.

A different type of contact group having contact surfaces $S_7$, $S_8$, $S_9$ is indicated at the connecting points X, Y in FIG. 2, wherein of these contacts the two side contact surfaces $S_7$ and $S_9$ are effective and the center contact surface $S_8$ is ineffective (dead). The contact group is associated with a thrust spring of the heel holder F, which facilitates a recognition that a signal is produced only in one position of the heel holder, namely, when the thrust counterpressure is too low or too high. It is easily understandable that FIG. 2 was worked out separately only to facilitate a simpler illustration, and that the contact group $S_7$, $S_8$, $S_9$ can be connected simultaneously with the contact group $S_4$, $S_5$, $S_6$ to the connecting points X, Y. However, it is also possible that the contact group for the thrust spring can be connected to the circuit in parallel with the contact group for the release spring. This possibility exists also for any desired number of further contacts and/or contact groups, so that the man skilled in the art has the possibility to associate with any control point a contact or a contact group. From what has been said up to now, it will be recognized that the binding parts themselves do not experience any change in their form upon occurrence of forces to indicate the incorrect condition; instead, individual switches and structural parts which, due to their elasticity, experience a form change, as for example individual spring elements.

Figure 4:
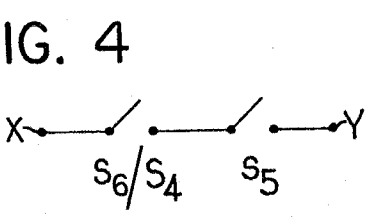
FIGS. 3 and 4 are further modifications of the embodiments of the sliding contacts according to FIGS. 1 or 2.
Figure 3:
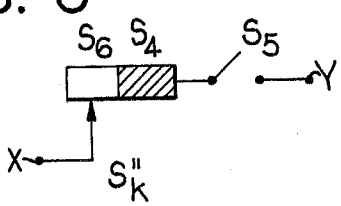

To indicate the modified embodiment of the contact group $S_7$, $S_8$, $S_9$, in relationship to the contact group $S_4$, $S_5$, $S_6$, FIG. 2 identifies the sliding contact by the reference $S_k'$. Further modifications are shown in FIGS. 3 and 4, wherein in FIG. 3 the sliding contact $S_k''$ is associated with a contact group, in which the one contact ($S_5$) is constructed as a closing or breaking contact; however, in the embodiment according to FIG. 4, there are combined two contacts ($S_6$, $S_4$) additionally to one single closing or breaking contact. These embodiments are only supposed to point out that with respect to the construction of closing and/or breaking contacts there are no limits as to the inventive use.

Figure 5:
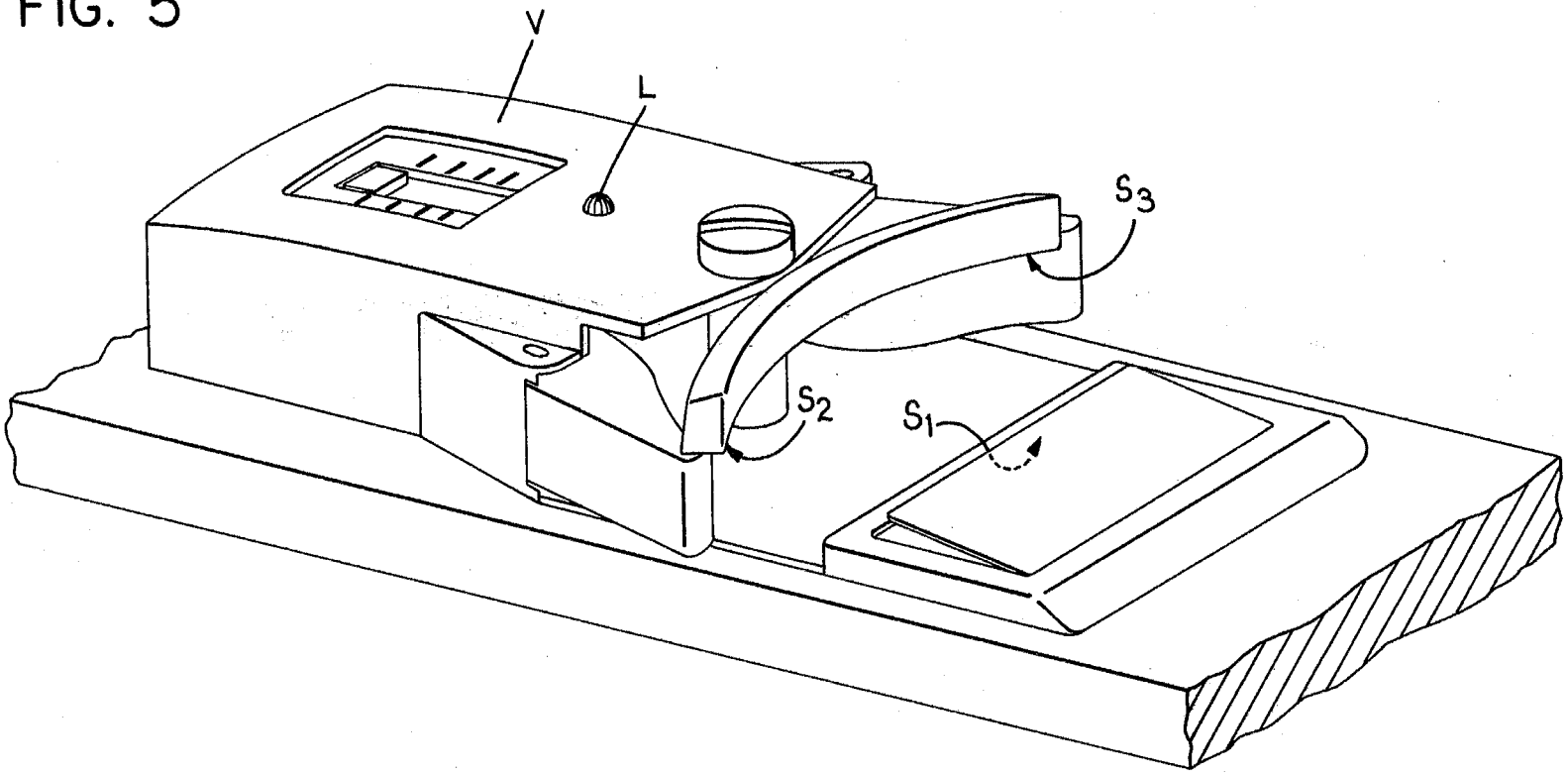
FIG. 5 illustrates a front jaw with details thereof in FIGS. 5*a*, 5*b* and 5*c;*
Figure 5A:
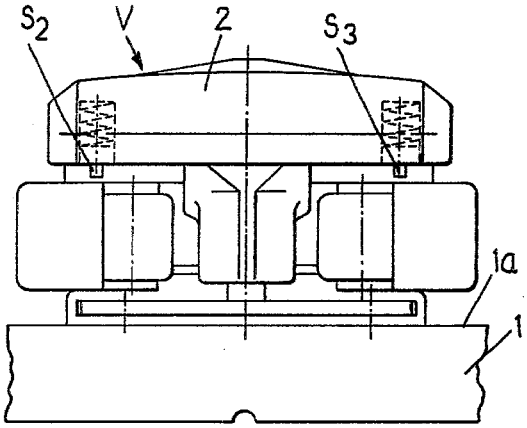
Figure 5B:
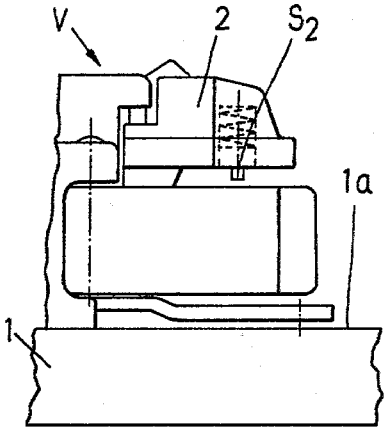
Figure 5C:
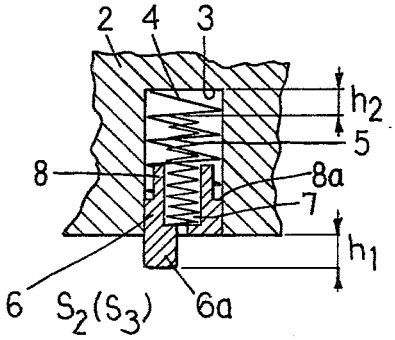
Figure 6E:
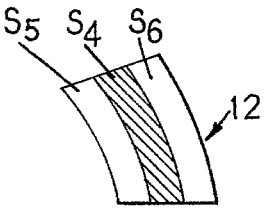
FIG. 6 is a perspective view of a heel holder with the contact points with details thereof in FIGS. 6*a* to 6*e*, 6*e' and 6f*.
Figure 6E:
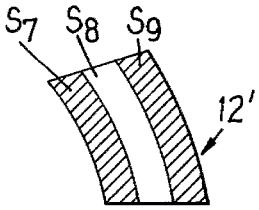
Figure 6F:
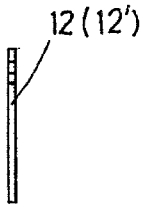
Figure 6:
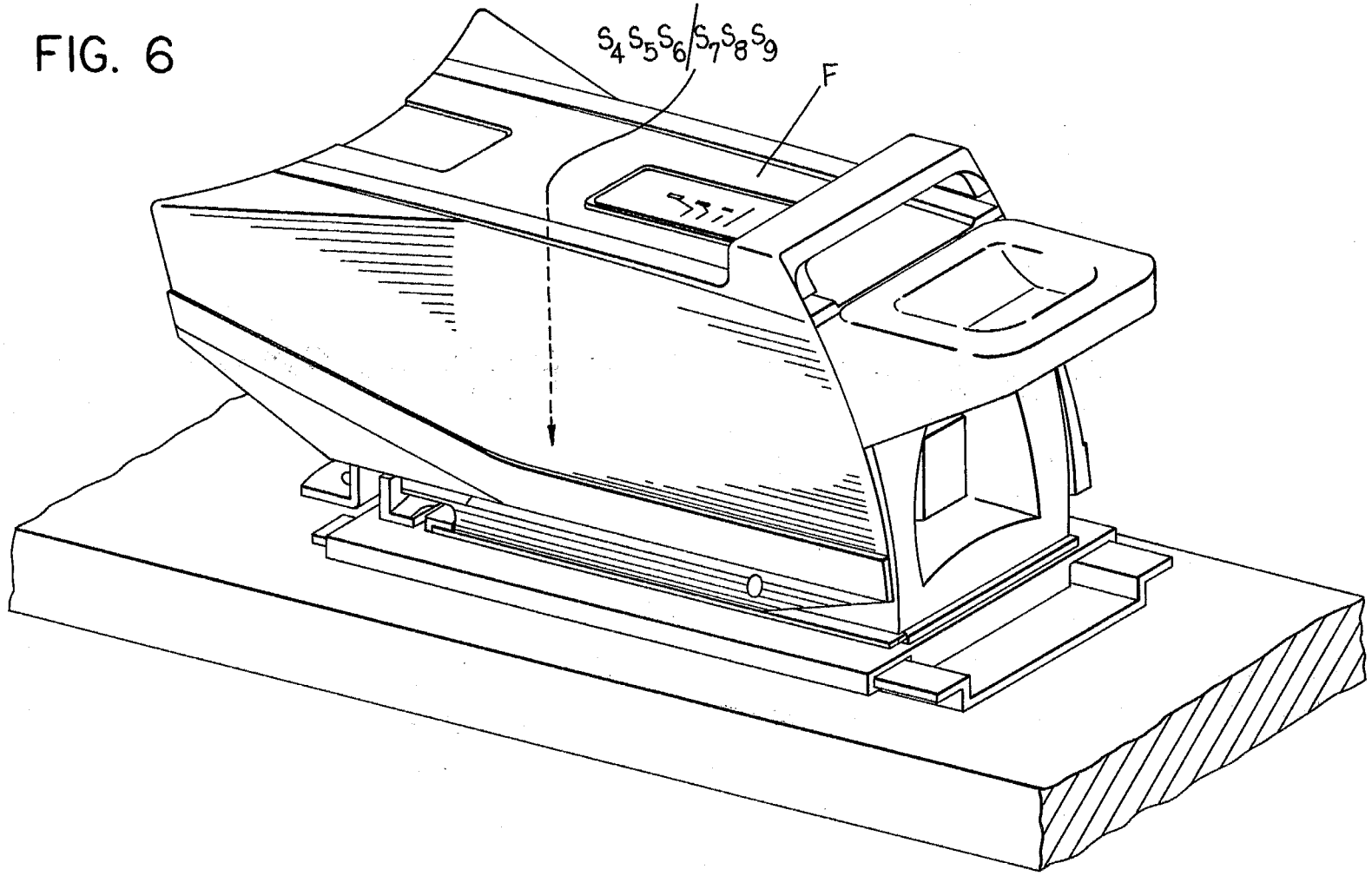

FIGS. 5 and 6 illustrate a practical arrangement on a front jaw and a heel holder, respectively. Particularly from FIG. 5 one can see the practical arrangement of the contact points. The contact $S_1$ is by itself intended as a main contact, which is associated with the stepping or sliding plate. Thus during insertion of a ski boot, the main contact $S_1$—but for one single exception—is closed in every case. The exception exists when the ski boot sole is deformed such that the inserted ski boot does not close the main contact $S_1$ and, instead, loads in a nonpermissible manner the two contacts $S_2$, $S_3$ on the underside of the sole hold-down means. For this case, the two contacts $S_2$, $S_3$ serve as a main contact group, so that a signal is generated in the case of an incorrect positioning of the heel holder. However, it is emphasized that the contacts $S_1$, $S_2$, $S_3$, which are associated with the front jaw V indicate among one another an incorrect condition of the ski boot with respect to the front jaw. In addition, the arrangement of the lamp L will be recognized at the front jaw V. The two contact groups $S_4$, $S_5$, $S_6$ or $S_7$, $S_8$, $S_9$ were only indicated at the heel holder F. The man skilled in the art should be able to arrange such contact groups in connection with FIGS. 1 and 2 without any additional illustration and description. The battery B itself can be in a recess of the ski or —if sufficient space exists—in a cavity in one of the ski binding parts. The practical arrangement of the contacts $S_2$ and $S_3$ according to FIG. 5 is illustrated in FIGS. 5*a* to 5*c* where FIG. 5*a* is a front view. FIG. 5*b* is a partial side view and FIG. 5*c* is a detailed sectional view. According to FIGS. 5*a* and 5*b* the contacts $S_2$ and $S_3$ are arranged symmetrical to the vertical center-line of the front jaw V and each close to one of the side parts of the sole holder 2 of this jaw. Further details and the arrangement of such a front jaw V on the upper surface 1*a* of a ski 1 is known per se shown and described in the U.S. Pat. No. 3,902,730. Both contacts $S_2$ and $S_3$ are illustrated in more details in FIG. 5*c*. In the following description reference is made to the contact $S_2$. The contact $S_2$ has a contact revolution body 6 with a finger-like extension 6*a* slidably arranged in the bore 3 of the sole-holder 2. The contact body 6 has a hole 7 for a contact spring 5 which will be described later. A sleeve 8 extends upwardly from the bottom of the hole 7 and forms steps 8*a* on the peripheral surface of the body 6 to hold one end of a spring 4; the other end of this spring is engagable with the upper-innersurface of the bore 3. In the hole 7 of the contact body 6 is arranged one end of the contact spring 5; the other end of the spring lies free if the extension 6*a* of the body 6 is not touched by the upper surface of the sole of a ski boot (not shown) as illustrated in the FIGS. 5*a* to 5*c*. In this case the free end of the extension 6*a* projects a distance $h_1$ from the bottom of the sole-holder 2 of the front jaw V and the free end of the contact spring 5 is spaced a smaller distance $h_2$ from the upper-innersurface of the bore 3 to ensure that the circuit will be closed when the body 6 is urged upwardly into the bore 3.

If the extension 6a is moved by the upper surface of the sole of the ski-boot (not shown) to the full extent of the distance $h_1$, the contact spring 5 closes a circuit as is shown and described in FIG. 1. The spring contact 5 will avoid deformations in the contact because of a high power working direct on the finger-like extension 6a. It is self-explanatory that the spring 4 works as a return spring for the body 6.

The construction of the contact $S_3$ is essentially the same. The distance $h_1$ of the finger-like extension 6a and the distance $h_2$ of the free end of the contact spring 5 to the upper-innersurface of the bore 3 has to be identical for both contacts $S_2$ and $S_3$.

Details of the heel-holder F are shown in the FIGS. 6a to 6f respectively. Such a heel holder F is shown and described per se in U.S. Pat. No. 3,876,219. The following description is limited therefore to the details of the invented parts.

Figure 6A:
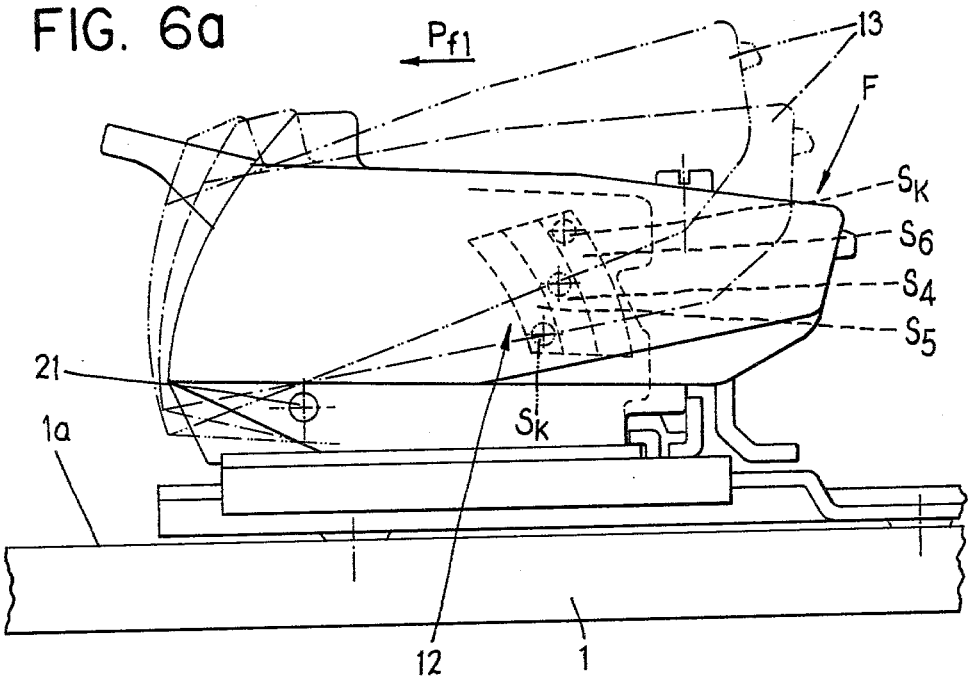
Figure 6B:
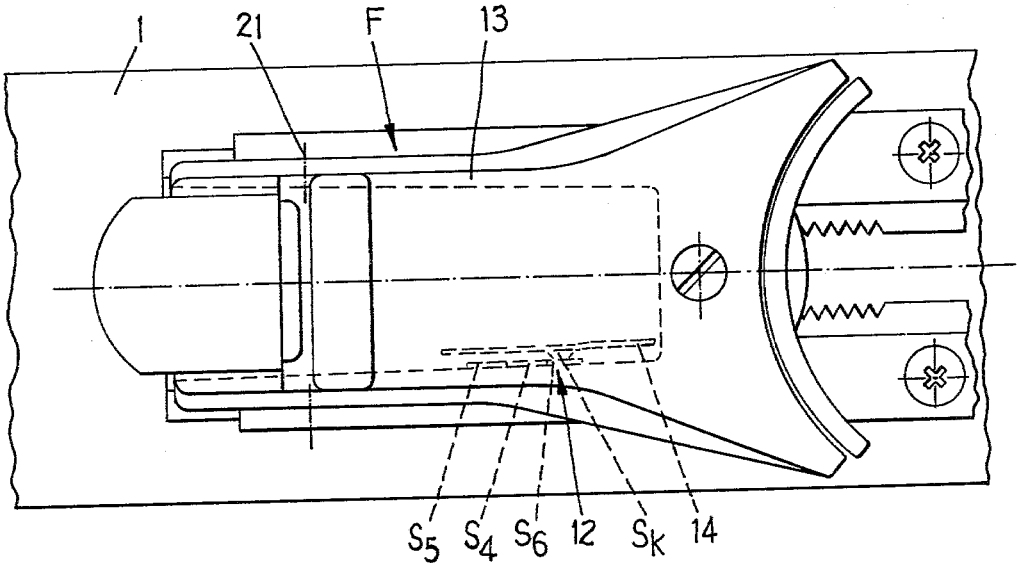
Figure 6C:
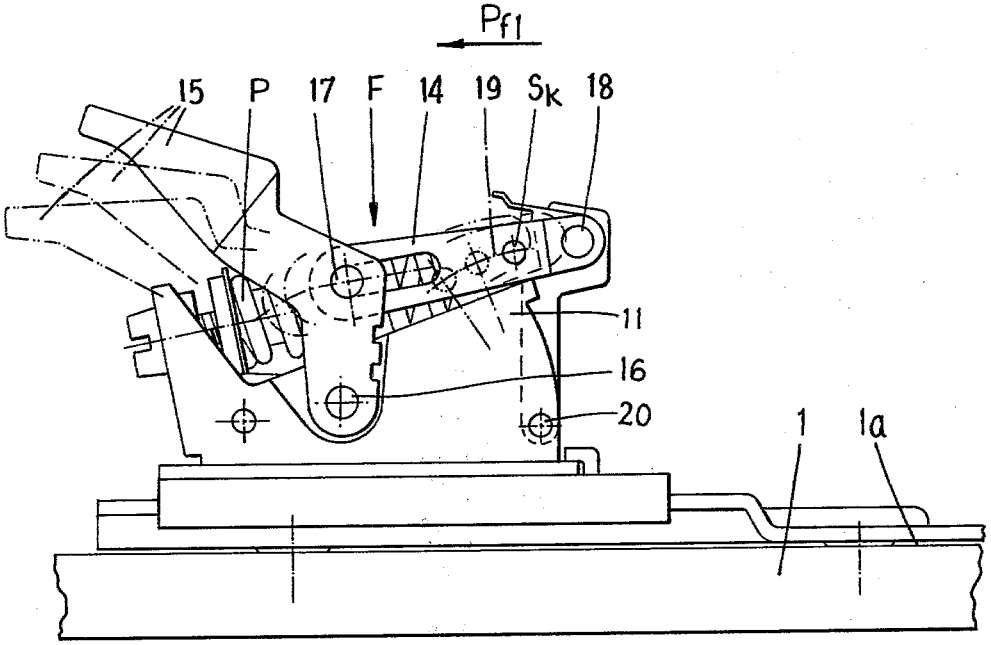
Figure 6D:
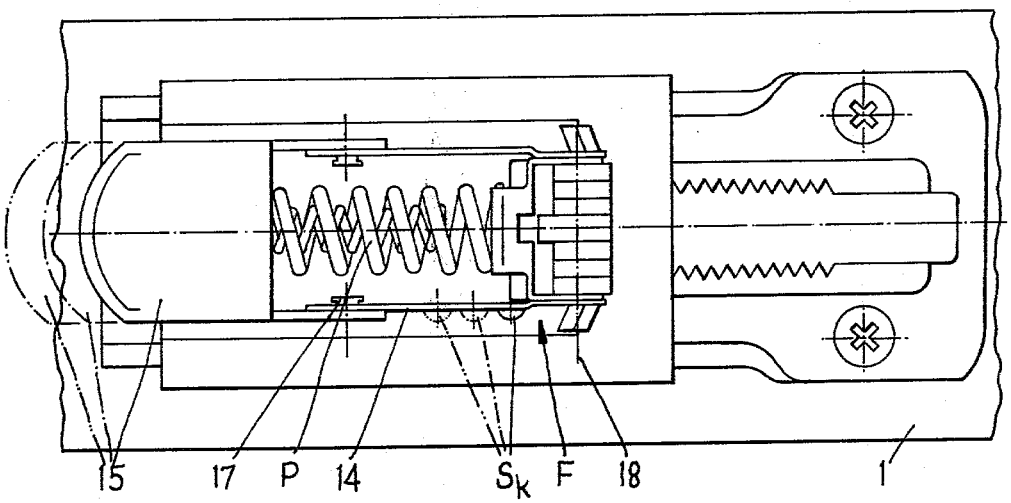
Figure 7:
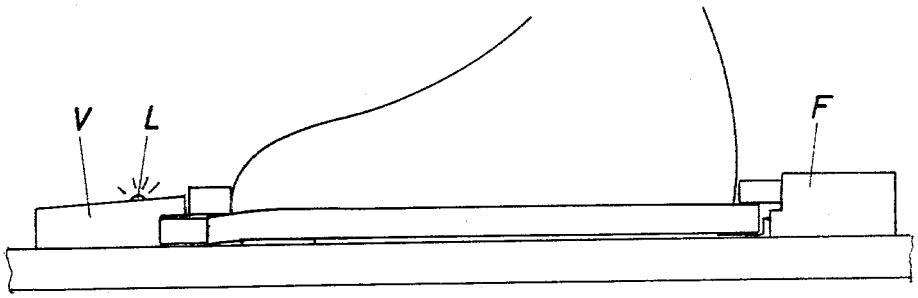
FIGS. 7 to 12 are various sources of errors involving a ski boot which is inserted into a ski binding.
Figure 8:
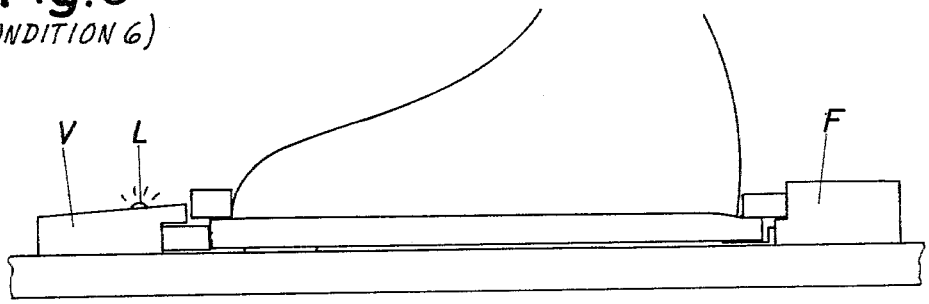
Figure 9:
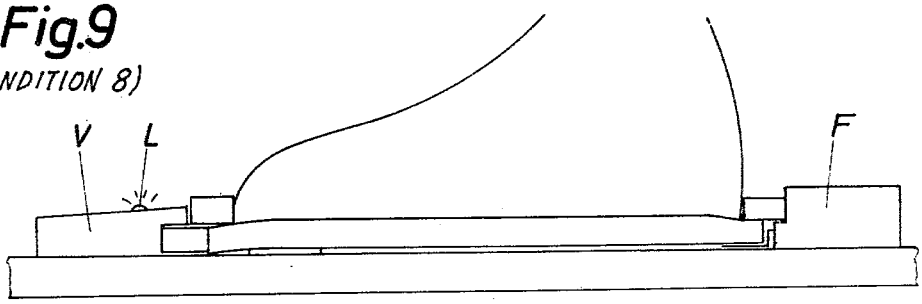
Figure 10:
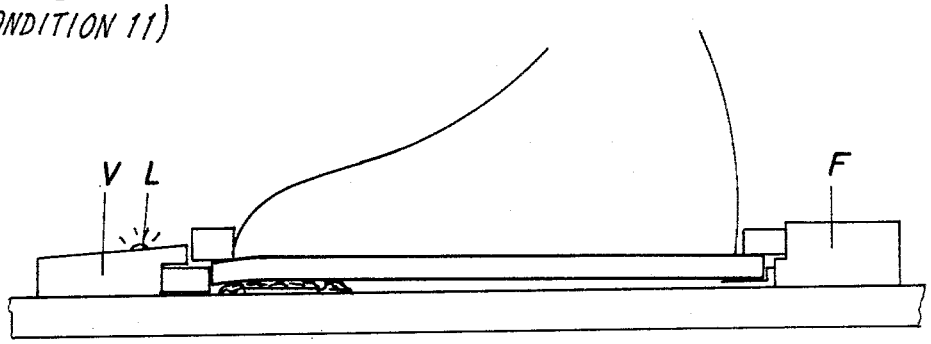
Figure 11:
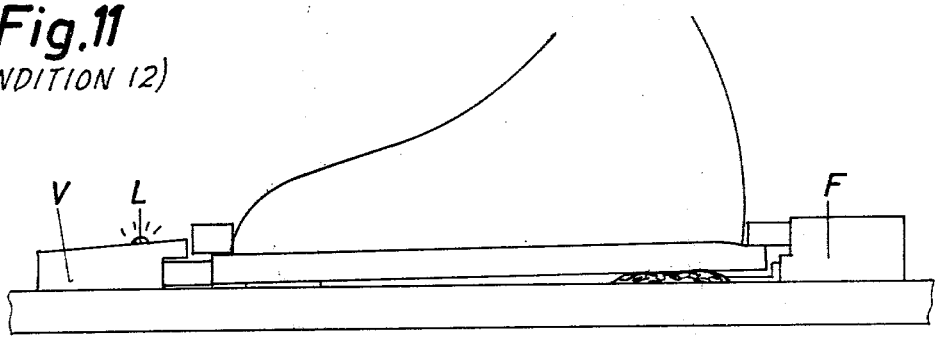
Figure 12:
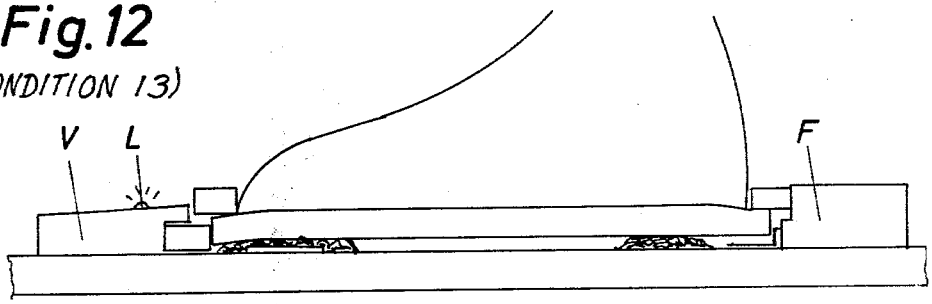

As can be seen from FIGS. 6a and 6b the contact surfaces $S_4$, $S_5$, $S_6$ are arranged by means of a contact plate 12 on one of the side-innersurfaces of the housing 13 of the heel-holder F. The form of the contact plate 12 and of the contact surfaces $S_4$, $S_5$, $S_6$, respectively is indicated in FIG. 6a in dotted lines and in FIGS. 6e and 6f as a separate construction unit. The sliding contact $S_K$ is arranged according to FIGS. 6c and 6d parallel to the contact plate 12 on the outside of one of the two side bars 14 which are movable against the force of the spring P by means of an arm 15. The arm 15 is pivoted on an axle 16 of the bearing block 11 of the heel-holder 17 of the side bars 14. The other ends of the side bars 14 are articulated on an axle 18 of a cam 19 which is pivoted on an axis 20 of the bearing block 11. The sliding contact $S_K$ has a form of a knub or button as shown in FIG. 6d; the position of this contact $S_k$ depends on the relative position of the side bars 14. As can be seen from the FIGS. 6a and 6b in the closed position of the heel holder F the sliding contact $S_k$ touches the ineffective contact $S_6$. In the open position of the heel-holder F the sliding contact $S_k$ contacts the other ineffective contact $S_5$.

If a quantity of snow etc. prevents a correct closing of the heel-holder F, the circuit will be closed as long as the sliding contact $S_k$ touches the effective contact $S_4$ as it has been described according to FIG. 1. FIGS 6a and 6b show in full lines the closed position of the heel holder F and in dotted lines the slide contact $S_k$ and the contact plate 12. FIG. 6a shows further in dash-dotted lines the incorrect closed position in which the slide contact $S_k$ touches the effective contact $S_6$ and in double dash dotted lines the full-open position in which the slide contact $S_k$ touches the other ineffective contact surface $S_5$. The construction of the contact plate 12' is similar to the above described plate 12 in connection with the contact surfaces $S_7$, $S_8$, $S_9$ according to FIG. 6b as it has been described according to FIG. 2. The form of each contact plate 12, 12' is defined through the radius of the swivel axis 21 of the housing 13.

FIGS. 7 to 12 illustrate various sources of error, which are each indicated by exaggerating the respective area. These conditions of the ski boot in relationship to the ski binding and vice versa are combined for a better understanding in the following table, wherein FIGS. 7 to 12 correspond one after the other with the individual conditions 5, 6, 8 and 11 to 13, respectively. The information of the table should, in connection with the associated figures, be sufficient for illustrating the individual conditions.

TABLE

| Condition | Description of condition of binding if desired with respect to ski boot | Signal | $S_1$ | $S_2$ | $S_3$ | $S_4$ | $S_5$ | $S_6$ | $S_7$ | $S_8$* | $S_9$* |
|---|---|---|---|---|---|---|---|---|---|---|---|
| 1 | Ready for transport, heel open | No | | | | | x | | | | |
| 2 | Ready for transport, heel closed | No | | | | | | x | | | |
| 3 | Boot clamped in, correctly adjusted | No | x | | | | | x | | | |
| 4 | Boot clamped in, correctly adjusted | No | | x | x | | | x | | | |
| 5 | Front jaw too low | Yes | x | x | x | | | x | | | |
| 6 | Front jaw good, heel too low | Yes | x | | | x | | | | | |
| 7 | Front jaw good, heel to low | Yes | | x | x | x | | | | | |
| 8 | Both front jaw and heel too low | Yes | x | x | x | x | | | | | |
| 9 | Correctly adjusted, edges | No | x | x | | | | x | | | |
| 10 | Correctly adjusted, edges | No | x | | x | | | x | | | |
| 11 | Snow below the ball area (V) | Yes | x | x | x | | | x | | | |
| 12 | Snow below the heel (F) | Yes | x | | | x | | | | | |
| 13 | Snow below the sole (V + F) | Yes | x | x | x | x | | | | | |
| 14 | Counter pressure good, height adjustment good | No | x | | | | | x | | x | |
| 15 | Counter pressure high, height adjustment good | Yes | x | | | | | x | | | x |
| 16 | Counter pressure low, height adjustment good | Yes | x | | | | | x | x | | |

As a particular inventively important measure, it is mentioned that the inventive control mechanism also facilitates an additional, so far practically not considerable adjusting with respect to the physical characteristics, namely the elasticity of the ski. As is known, skis are produced with various elasticity characteristics. Stiff skis having a smaller amount of elasticity suffer when travelling through a depression a smaller amount of deformation, skis with a greater elasticity, however, undergo an increased amount of deformation. Since when travelling through a depression the sole of the ski boot adopts with respect to the bent ski the position of a chord with respect to an arc, the heel holder is moved by the thrust spring in direction toward the front jaw, which causes the release force to change. A heel holder which in "dry" condition is adjusted correctly can thus lead to misreleases. The inventive monitoring system permits an adjustment of the pushing force which is correct also for a flexed ski, because the bent ski can be simulated in connection with the installation and the installer and also the skier can obtain the assurance with respect to the correct adjustment at a design of the contact group $S_7$, $S_8$, $S_9$ which considers also this circumstance.

As one can see from FIG. 1, a contact breaker U can be associated with the lamp L, through which a blinking light signal is produced. As is known, blinking, visual and acoustic signals can better be recognized than continuous ones.

The invention is not limited to the illustrated exemplary embodiments. Further modifications both with respect to the circuit and also with respect to the current source, the element which emits the signal and also the contacts or contact groups and their arrangement are possible. For example, a contact group can be arranged along an arc, wherein the sliding contact moves along said arc and/or the radius. Also a three-dimensional arrangement of the contacts and/or contact groups can be provided. If needed, the main contact can be operated arbitrarily, for example by hand or foot.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An electrically operated device for use on a ski binding arrangement having a toe jaw with a sole holder adapted to engage the sole of a ski boot and a heel holder, said electrically operated device indicating an incorrect insertion of a ski boot into said ski binding arrangement, comprising:

an electrical supply source;

an electrical indicating mechanism series connected to said electrical supply source; and first and second electric circuits connected in parallel to each other and across said series connected electrical supply source and said indicating mechanism, said first electric circuit comprising plural first electrical switch means juxtaposed said toe jaw, at least one of which constituting a first main switch which must be actuated in response to a presence of a ski boot and to facilitate an indication of an incorrect insertion of said ski boot therein, the remainder of said plural first switch means being mounted on the underside of said sole holder on said toe jaw so that said remainder of said first switch means must all become actuated in response to the presence of an incorrectly inserted ski boot into said toe jaw, said second electric circuit comprising at least one second electrical switch means juxtaposed said heel holder and which is actuated in response to an incorrect insertion of said ski boot therein;

whereby an actuation of all of said first switch means juxtaposed said toe jaw, on the one hand, and an actuation of said second switch means juxtaposed said heel holder, on the other hand, will assure an energization of said electrical indicating mechanism to warn the user of said ski binding arrangement of an incorrect insertion of said ski boot therein.

2. The electrically operated device according to claim 1, wherein said first electrical switch means are plural switches connected in series, each of said switches being actuated in response to an impermissible pressure of said ski boot thereon.

3. The electrically operated device according to claim 1, wherein said heel holder has a release spring, wherein said second switch means is associated with said release spring and comprises a sliding contact movable in response to a movement of said release spring through plural regions, one of which corresponds to a position of said ski boot incorrectly inserted into said heel holder and effecting an energization of said indicating mechanism.

4. The electrically operated device according to claim 3, wherein said plural regions include at least three side-by-side contact surfaces, wherein only the center contact surface is electrically connected to said indicating mechanism, and wherein the two contact surfaces straddling said center contact surface are constructed as ineffective, and wherein said three contact surfaces are associated with a predesignated position of said release spring on said heel holder.

5. The electrically operated device according to claim 3, wherein said heel holder has at least one thrust spring urging said heel holder toward said toe jaw, wherein said plural regions include at least three side-by-side contact surfaces, wherein the center contact surface is ineffective and the two contact surfaces straddling said center contact surface are effective and electrically connected to said indicating mechanism, wherein said three contact surfaces are associated with a predesignated position of said thrust spring on said heel holder.

6. The electrically operated device according to claim 1, wherein said electrical indicating mechanism is a lamp.

7. An electrically operated device for use on a ski binding arrangement to indicate an incorrect insertion of a ski boot into said ski binding arrangement, comprising:

an electrical supply source;

an electrical warning, indicating mechanism series connected to said electrical supply source; and electrical switch means connected in electrical circuit with said electrical warning, indicating mechanism and said supply means and being responsive to an incorrect positioning of said ski boot when fixedly held in said ski binding arrangement to electrically complete the electrical connection of said supply means to said warning, indicating mechanism to effect a warning to the user of said ski binding arrangement that said ski boot is incorrectly fixedly, inserted into said ski binding arrangement.

* * * * *